United States Patent [19]

Tani et al.

[11] 4,415,381

[45] Nov. 15, 1983

[54] METHOD FOR FORCEDLY COOLING A HEATED METAL PLATE

[75] Inventors: Saburo Tani; Mitsuru Yamawaki; Yukifumi Ogawa; Kenji Hirabe, all of Fukuyama, Japan

[73] Assignee: Nippon Kokan Kabushiki Kaisha, Tokyo, Japan

[21] Appl. No.: 284,376

[22] Filed: Jul. 17, 1981

[30] Foreign Application Priority Data

Jul. 25, 1980 [JP] Japan ..... 55-101246

[51] Int. Cl.[3] ..... C21D 9/46

[52] U.S. Cl. ..... 148/153; 148/156

[58] Field of Search ..... 148/153, 155, 156, 143

[56] References Cited

U.S. PATENT DOCUMENTS 3,756,869 9/1973 Melloy et al. ..... 148/143

*Primary Examiner*—R. Dean

*Attorney, Agent, or Firm*—Frishauf, Holtz, Goodman and Woodward

[57] ABSTRACT

A method for forcedly cooling a heated metal plate, which comprises: moving a heated metal plate horizontally in the longitudinal direction of said metal plate at a prescribed speed through a cooling equipment comprising a plurality of rows of nozzles arranged at prescribed intervals in the width direction of said metal plate above and below said metal plate; and spraying a cooling liquid from said nozzles onto the upper and lower surfaces of said metal plate during moving of said metal plate through said cooling equipment to cool said metal plate to a prescribed temperature. The method is characterized by: starting said spraying of the cooling liquid from said nozzles when a prescribed length of the trailing end portion of said metal plate during moving of said metal plate still remains outside said cooling equipment; and discontinuing said spraying of the cooling liquid from said nozzles when a given length of the leading end portion of said metal plate during moving of said metal plate projects outside of said cooling equipment by a length equal to said prescribed length.

2 Claims, 7 Drawing Figures

METHOD FOR FORCEDLY COOLING A HEATED METAL PLATE

FIELD OF THE INVENTION

The present invention relates to a method for forcedly cooling a heated metal plate, which applies a uniform forced cooling, without causing strain and non-uniform distribution of mechanical properties, to a heated metal plate such as a steel plate having been rolled by a hot rolling mill.

BACKGROUND OF THE INVENTION

When cooling a heated metal plate such as a steel plate having been rolled or reheated, it is the usual practice to apply a forced cooling by spraying a cooling liquid such as water to the upper and lower surfaces of the heated metal plate, with a view to improving the production efficiency or the material quality of the metal plate. The forced cooling is generally applied at present to a heated metal plate through an on-line cooling equipment comprising a plurality of rows of nozzles arranged at prescribed intervals in the width direction of the metal plate above and below the metal plate, by moving the metal plate horizontally in the longitudinal direction of the metal plate at a prescribed speed, and spraying a cooling liquid from the nozzles onto the upper and lower surfaces of the metal plate during moving through the cooling equipment. The cooling liquid is applied onto the metal plate in a state of mist, spray or laminar flow.

When forcedly cooling the heated metal plate by the above-mentioned method, there have been problems of the occurrence of strain in the metal plate and a non-uniform distribution of mechanical properties of the metal plate by cooling. This is attributable to the fact that, during forced cooling, since the end portions of the metal plate in the width direction as well as in the longitudinal direction are excessively cooled as compared with the remaining portion thereof, the metal plate is not uniformly cooled.

To avoid the above inconveniences, various studies were carried out to find a method for forcedly cooling a heated metal plate uniformly. Uniform cooling in the width direction of the metal plate has almost been made possible by, for example, controlling the amount of cooling liquid ejected along the width direction of the metal plate so as to provide a uniform cooling temperature in the width direction of the metal plate. However, an effective means is not as yet developed for uniform cooling of the metal plate in the longitudinal direction thereof.

Causes of the impossibility of uniform cooling of a heated metal plate when forcedly cooling the metal plate, are as follows. For example, when spraying a cooling liquid, by the above-mentioned method, to the upper and lower surfaces of the heated steel plate moving in a cooling equipment at a prescribed speed, the cooling liquid sprayed onto the lower surface of the steel plate drops down immediately after hitting the lower surface of the steel plate and poses no problem, whereas the cooling liquid sprayed onto the upper surface of the steel plate flows down in the directions shown by the arrows in FIG. 1 in the longitudinal direction of the steel plate 1 as well as in the width direction thereof from the edgesthereof after hitting the upper surface of the heated steel plate 1.

As a result, the cooling rate of the steel plate 1 near the edge thereof is higher than that of the remaining portion thereof. Therefore, the temperature of the steel plate 1 after the lapse of a certain period of time since the start of cooling becomes lower in the portion near the edge thereof than that in the remaining portion thereof. Thus the portion near the edge of the steel plate 1 is excessively cooled. FIG. 2 is a graph illustrating the temperature distribution of the steel plate in the longitudinal direction thereof in case that the steel plate 1 having in size a thickness of 20 mm, a width of 3,200 mm, and a length of 12,000 mm; and in temperature 810° C. is forcedly cooled to attain a target temperature of 700° C. at stoppage of forced cooling. According to FIG. 2, the middle portion of the steel plate 1 was cooled almost to the target temperature (700° C.), whereas the leading and trailing end portions of the steel plate 1 were cooled to a temperature considerably lower than the above-mentioned target temperature.

FIG. 3 is a perspective view illustrating the shape of a steel plate 1 when the steel plate 1 cooled forcedly to the above-mentioned target temperature was further subjected to natural cooling to the ambient temperature. As shown in FIG. 3, in the portions (a) respectively having a length of about 750 mm from the leading and trailing ends of the steel plate 1 along the longitudinal direction thereof, a deformation (b) having a height of up to about 50 mm was occurred. FIG. 4 is a graph illustrating the results of a tension test carried out on test pieces sampled from a steel plate 1 subjected to a cooling treatment as mentioned above. As shown in FIG. 4, tensile strength of the steel plate 1 is remarkably higher in the portions (c) with a length of about 500 mm along the longitudinal direction of the steel plate from the leading and trailing ends thereof than the remaining portion of the steel plate.

As described above, when a heated steel plate is forcedly cooled by spraying a cooling liquid onto the upper and lower surfaces of the steel plate, the cooling rate becomes higher in the leading and trailing end portions of the steel plate than in the remaining portion of the steel plate, thus leading to an excessive cooling of the above-mentioned leading and trailing end portions. At the stoppage of forced cooling, therefore, the temperature of the above-mentioned leading and trailing end portions is far lower than the target temperature. As a result, deformation of the steel plate occurs during the natural cooling, together with non-uniform distribution of the mechanical properties of the steel plate.

When forcedly cooling a heated steel plate, the target cooling temperature should preferably be within a range of from 500° to 650° C. in view of actual operation. The reasons are as follows. When setting a target cooling temperature lower than 500° C., for example, the ambient temperature, and then forcedly cooling the steel plate to the above ambient temperature, the strain occurring in the steel plate by forced cooling becomes increasingly larger, and it becomes more and more difficult to correct the strain. In the aspect of structure, the steel plate would contain much bainite, or would have a structure mixed with martensite, and this deteriorates the steel plate in toughness and makes it an unserviceable product. When the target cooling temperature is set at a temperature over 650° C., on the other hand, forced cooling cannot refine the crystallization structure of the steel plate, and does not provide material quality improving effects on the steel plate. When forcedly cooling a heated steel plate, therefore, it is believed to be the optimum operating practice to set a target temperature of from 500° to 650° C. at stoppage of forced cooling and to apply natural cooling subsequently to the ambient temperature in view of the extent of strain caused by cooling, the limit of possible correction of the occurred strain, and the improving effects of material quality through cooling.

Under such circumstances, there is an increasing demand for a method for forcedly uniformly cooling a heated metal plate such as a steel plate, which has been hot-rolled or reheated, in the longitudinal direction thereof to a prescribed temperature without causing occurrences of strain and non-uniform distribution of mechanical properties of the metal plate, but such a method is not as yet proposed.

SUMMARY OF THE INVENTION

A principal object of the present invention is therefore to provide a method for forcedly cooling a heated metal plate uniformly in the longitudinal direction of the metal plate when forcedly cooling the heated metal plate to prescribed temperature by spraying a cooling liquid onto the upper and lower surfaces of the metal plate.

Another object of the present invention is to provide, when forcedly cooling a heated metal plate to a prescribed temperature by spraying a cooling liquid onto the upper and lower surfaces of said metal plate, a method for forcedly cooling the heated metal plate without causing occurrences of both the strain along the longitudinal direction of the metal plate and the non-uniform distribution of mechanical properties of the metal plate after cooling.

In accordance with one of the features of the present invention, there is provided a method for forcedly cooling a heated metal plate, which comprises:

moving a heated metal plate horizontally in the longitudinal direction of said metal plate at a prescribed speed through a cooling equipment comprising a plurality of rows of nozzles arranged at prescribed intervals in the width direction of said metal plate above and below said metal plate; and, spraying a cooling liquid from said nozzles onto the upper and lower surfaces of said metal plate during moving of said steel plate through said cooling equipment to cool said metal plate to a prescribed temperature;

said method being characterized by:

starting said spraying of the cooling liquid from said nozzles when a prescribed length of the trailing end portion of said metal plate during moving of said metal plate still remains outside of said cooling equipment; and, discontinuing said spraying of the cooling liquid from said nozzles when a given length of the leading end portion of said metal plate during moving of said metal plate projects outside of said cooling equipment by a length equal to said prescribed length.

DETAILED DESCRIPTION OF THE PREFERRED EMBODIMENTS

From the above-mentioned point of view, various tests and research activities were carried out with a view to developing a method for forcedly cooling a heated metal plate to a prescribed temperature uniformly in the longitudinal direction thereof without causing the occurrences of strain and non-uniform distribution of mechanical properties of the metal plate. As a result, we obtained a finding that, when forcedly cooling a heated metal plate, the temperature distribution in the longitudinal direction of the metal plate at the stoppage of forced cooling can be made uniform by using a shorter cooling period for both the leading and training end portions of the metal plate than that for the remaining portion of the metal plate.

Now, the method of the present invention for forcedly cooling a heated metal plate will be described below by means of steel plates as examples with reference to the drawings.

Figure 1:
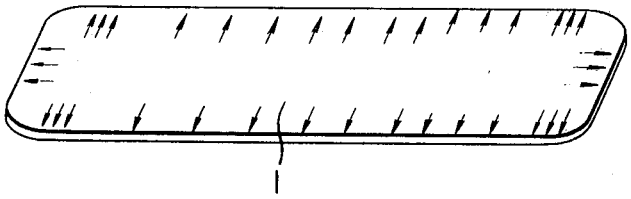
FIG. 1 is a descriptive view illustrating the state of flow of the cooling liquid sprayed onto the upper surface of a heated steel plate.
Figure 2:
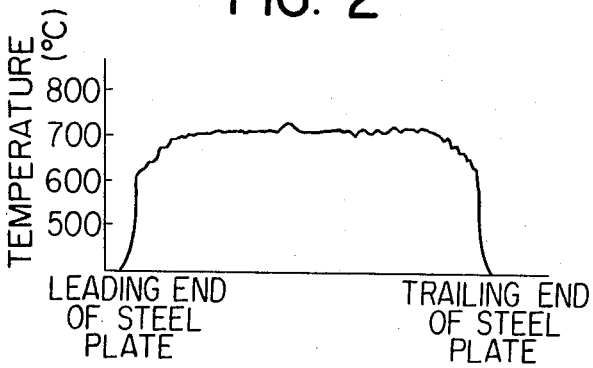
FIG. 2 is a graph illustrating the temperature distribution of a steel plate in the longitudinal direction thereof in case that the steel plate is forcedly cooled to a target temperature of 700° C. at stoppage of forced cooling.
Figure 3:
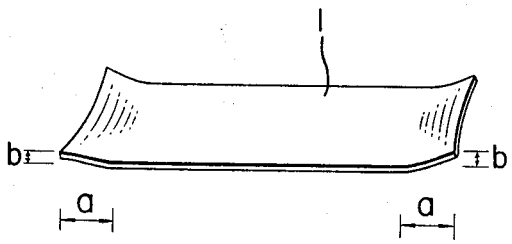
FIG. 3 is a perspective view illustrating the shape of a steel plate when the steel plate forcedly cooled to a target temperature of 700° C. at stoppage of forced cooling is subsequently subjected to a natural cooling to the ambient temperature.
Figure 4:
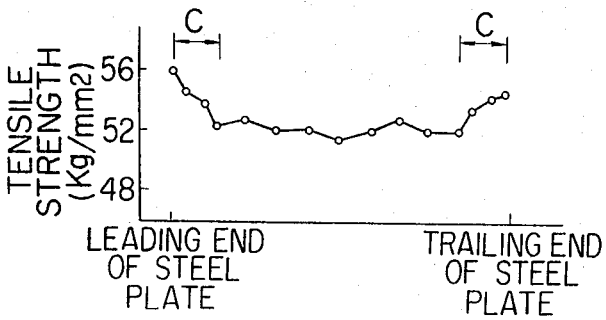
FIG. 4 is a graph illustrating the results of a tension test carried out on the steel plate shown in FIG. 3.
Figure 5:
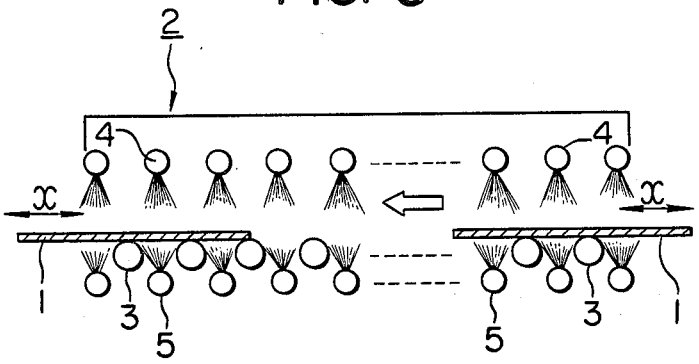
FIG. 5 is a schematic partial descriptive view illustrating an embodiment of the method of the present invention.

FIG. 5 is a schematic partial descriptive view illustrating an embodiment of the method of the present invention. In FIG. 5, 1 is a heated steel plate. 2 is a cooling equipment. 3 is a roller table extending horizontally. The steel plate 1 is moved horizontally in the longitudinal direction of the steel plate 1 at a prescribed speed by the roller table 3 in the cooling equipment 2. In the cooling equipment 2, a plurality of rows of upper nozzles 4 and a plurality of rows of lower nozzles 5 are arranged at prescribed intervals in the width direction of the steel plate 1 above and below the steel plate 1. The steel plate 1 during moving through the cooling equipment 2 is cooled to a prescribed temperature by a cooling liquid sprayed from the plurality of rows of the upper nozzles 4 and the lower nozzles 5 onto the upper and lower surfaces of the steel plate 1.

In the present invention, spraying of the cooling liquid from the plurality of rows of the upper nozzles 4 and the lower nozzles 5 is started when the trailing end portion of the heated steel plate 1 which is introduced into the cooling equipment 2 remains outside the cooling equipment 2 by a prescribed length "x". No spray of the cooling liquid is applied to the steel plate 1 until this moment. More specifically, spraying of the cooling liquid onto the steel plate 1 is started after stoppage of the movement of the steel plate 1 when the trailing end portion of the heated steel plate 1 still remains outside the cooling equipment 2 by a prescribed length "x". At the same time, the steel plate 1 is moved again and forcedly cooled by the above-mentioned spray of the cooling liquid during moving of the steel plate through the cooling equipment 2 at a prescribed speed.

Then, spraying of the cooling liquid from the plurality of rows of the upper nozzles 4 and the lower nozzles 5 is discontinued when the leading end portion of the steel plate during moving through the cooling equipment 2 projects to outside the cooling equipment 2 by the above prescribed length "x". As a result, the cooling period of the steel plate 1 cooled by the cooling liquid sprayed from the plurality of rows of the upper nozzles 4 and the lower nozzles 5 during moving at a prescribed speed through the cooling equipment 2 is shorter in the leading and trailing end portions thereof than in the remaining portion thereof. It is therefore possible to cool the steel plate 1 uniformly in the longitudinal direction thereof by setting the prescribed length "x" at the optimum length. Start of spraying of the cooling liquid may be effected by temporarily discontinuing the movement of the steel plate 1, or without interrupting the movement thereof.

Figure 6:
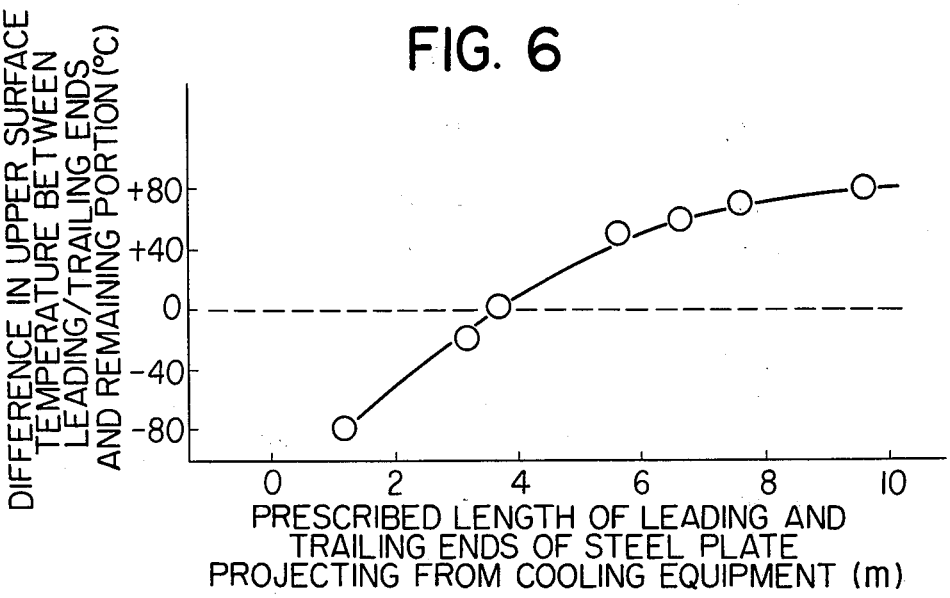
FIG. 6 is a graph illustrating the relationship between: the prescribed length "x" of the respective leading and trailing end portions of the steel plate in which the latter remains outside the cooling equipment at the start of cooling and the former projects to outside the cooling equipment at the stoppage of cooling, and the difference in the upper surface temperature of the steel plate between the leading and trailing end portions thereof and the remaining portion thereof in the present invention; and, FIG. 7 is a graph illustrating the tensile strength in the longitudinal direction of a steel plate cooled forcedly in accordance with the method of the present invention.

FIG. 6 is a graph illustrating the relationship between: the prescribed length "x" of the respective leading and trailing end portions of the steel plate 1 in which the latter remains outside the cooling equipment 2 at the start of cooling and the former projects to outside the cooling equipment at the stoppage of cooling, and the difference in the upper surface temperature of the steel plate 1 between the leading and trailing end portions thereof and the remaining portion thereof in the present invention and the cooling conditions are as follows:

(1) Size of the steel plate: Thickness: 19.7 mm; width: 3,200 mm; and length: 13,500 mm (2) Steel plate temperature: 810° C.

(3) Length of the cooling equipment: 25 m (4) Cooling period: 0.5 minute.

As shown in FIG. 6, when a length of 3.8 m was employed as the prescribed length "x" of the respective leading and trailing end portions of the steel plate 1 in which the latter remained outside the cooling equipment 2 at the start of cooling and the former projected to outside the cooling equipment 2 at the stoppage of cooling, the difference in the upper surface temperature of the steel plate 1 between the leading and trailing end portions thereof and the remaining portion thereof became zero, and thus it was possible to cool the steel plate 1 uniformly in the longitudinal direction thereof.

In the present invention, the prescribed length "x" of the respective leading and trailing end portions of a heated metal plate 1 in which the latter remains outside the cooling equipment 2 at the start of cooling and the former projects to outside the cooling equipment 2 at the stoppage of cooling, can be calculated from the following equations, when the length of the cooling equipment 2 is "L", the moving speed of the metal plate 1 in the cooling equipment 2 is "S", and the length of the metal plate 1 is "l".

$$\frac{L-(l-x)+x}{S}=\tau_c \tag{1}$$

where, $\tau_c$: forced cooling period for the portion of the metal plate 1 other than the projecting leading end portion and the remaining trailing end portion both having the prescribed length "x" of the metal plate.

$$\frac{L-(l-x)}{S}=\tau_E \tag{2}$$

where, $\tau_E$: forced cooling period for the leading and trailing end portions of the metal plate 1 both having the prescribed length "x" of the metal plate 1.

By eliminating "x" from the equations (1) and (2) presented above, we obtain the following equation (3):

$$2S(\tau_E/\tau_c)-S=(L-l)/\tau_c \tag{3}$$

and then, the following equation (4):

$$\tau_E/\tau_c=V_c/V_E=K \tag{4}$$

where, $V_c$: forced cooling rate for the portion of the metal plate 1 other than the projecting leading end portion and the remaining trailing end portion both having the prescribed length "x" of the metal plate 1;

$V_E$: forced cooling rate for the leading and trailing end portions of the metal plate 1 both having the prescribed length "x" of the metal plate 1.

The following equations (5) and (6) can be derived from the above-mentioned equations (1), (2) and (4):

$$x=S\tau_c(1-K) \tag{5}$$

$$x=(L-l)\left(\frac{1-K}{2K-1}\right) \tag{6}$$

In addition, the following equation (7) can be derived from the above-mentioned equations (3), (4) and (6):

$$S\tau_c(2K-1)=L-l \tag{7}$$

In the equations presented above, "$V_c/V_E$" is a constant determined by the material and size of the metal plate 1, and "$\tau_c$" is determined by the target cooling temperature during cooling. For "L" and "S", adequate values are selected depending upon the length "l" of the metal plate 1.

Now, the present invention is described below in more detail by means of examples.

EXAMPLE 1

A steel plate 1 having been rolled by a hot rolling mill to a size including a thickness of 12 mm, a width of 2,500 mm and a length of 15,000 mm and having a temperature of 800° C. was introduced into a cooling equipment 2 as shown in FIG. 5, and then moved through the cooling equipment 2 at a prescribed speed, and at the same time, the steel plate 1 was cooled to a target cooling temperature of 500° C. by a cooling liquid sprayed from upper nozzles 4 and lower nozzles 5. The cooling equipment 2 had a length "L" of 18 m, and the forced cooling period "$\tau_c$" of the portion of the steel plate 1 other than the leading and trailing end portions thereof both having a prescribed length "x" was set at 0.5 minute, with a constant "K" of 0.8 which had previously been measured. Then, the prescribed length "x" of the respective leading and trailing end portions of the steel plate 1 in which the latter remained outside the cooling equipment 2 at the start of cooling and the former projected to outside the cooling equipment 2 at the stoppage of cooling, was calculated as 1 m as follows from the above-mentioned equations (5) and (7).

First, the above-mentioned conditions were substituted into the equation (7) to calculate the moving speed "S" of the steel plate 1 through the cooling equipment 2:

$$S\times 0.5\times(2\times 0.8-1)=18-15$$

$$S=10$$

Then, the value as obtained as above was substituted into the equation (5) to calculate "x":

$$x=10\times 0.5\times(1-0.8)$$

$$x=1$$

With reference to the result of calculation as described above, the steel plate 1 was forcedly cooled under the above-mentioned conditions with the prescribed length "x" of 1 m. This permitted uniform cooling of the steel plate 1 in the longitudinal direction thereof.

EXAMPLE 2

Under the same conditions as in the Example 1 presented above except for the length "L" of the cooling equipment 2 being 20 m, the steel plate 1 was forcedly cooled. Then, the prescribed length "x" was calculated as 1.66 m as follows as derived from the equations (5) and (7).

First, by substituting the above-mentioned conditions into the equation (7), the moving speed "S" of the steel plate 1 in the cooling equipment 2 was calculated:

$$S\times 0.5\times(2\times 0.8-1)=20-15$$

$$S=16.6$$

Then, "x" was calculated by substituting the value thus obtained into the equation (5).

$$x=16.6\times 0.5\times(1-0.8)$$

$$x=1.66$$

As a result of forced cooling of the steel plate 1 under the above-mentioned conditions with a value of "x" of 1.66 m, it was possible to cool the steel plate 1 uniformly in the longitudinal direction thereof.

EXAMPLE 3

Figure 7:
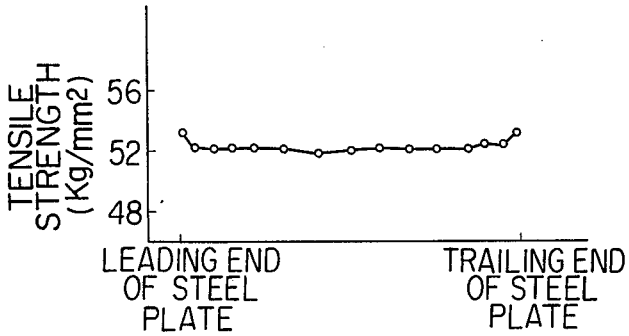

A steel plate 1 having been rolled by a hot rolling mill to a size including a thickness of 20 mm, a width of 3,000 mm and a length of 11,500 mm, and having a temperature of 810° C. was cooled in a cooling equipment 2 having a length "L" of 25 m with the prescribed length "x" of 4 m and a cooling period "$\tau_c$" of 25 second. Tensile strength was measured on test pieces sampled from the steel plate 1 thus obtained. As is clear from FIG. 7 which is a graph showing the results of this measurement, the tensile strength of the steel plate 1 is almost constant over the length thereof, and the maximum deviation in tensile strength between the both end portions and the middle portion in the longitudinal direction of the steel plate 1 was only 1.2 kg/mm$^2$. As a result of the above, it becomes possible to make the steel plate 1 a product having uniform mechanical properties.

All the above-mentioned examples have covered cases of forced cooling of a heated steel plate. However, it is obvious that the present invention is not limited to a steel plate but is applicable also to other metal plates.

According to the method of the present invention, as described above in detail, when forcedly cooling a heated metal plate to a prescribed temperature by spraying a cooling liquid onto the metal plate, it is possible to cool the metal plate uniformly in the longitudinal direction thereof, thus preventing the occurrence of strain along the longitudinal direction of the metal plate and to make the metal plate a product provided with uniform mechanical properties, thus providing industrially useful effects.

What is claimed is:

1. In a method for forcedly cooling a heated metal plate uniformly in the longitudinal direction of the metal plate, which comprises:

moving a heated metal plate horizontally in the longitudinal direction thereof at a prescribed speed through a cooling apparatus comprising a plurality of rows of nozzles arranged at prescribed intervals in the width direction of said metal plate above and below said metal plate; and, spraying a cooling liquid from said nozzles onto the upper and the lower surfaces of said metal plate during moving of said metal plate through said cooling apparatus to cool said metal plate to a prescribed temperature;

the improvement comprising:

starting said spraying of said cooling liquid from said nozzles when a prescribed length of the trailing end portion of said metal plate during moving of said metal plate still remains outside of said cooling apparatus;

discontinuing said spraying of said cooling liquid from said nozzles when a given length of the leading end portion of said metal plate during moving of said metal plate projects outside of said cooling apparatus by an amount such that said given length equals said prescribed length;

said prescribed length of the trailing end portion of said metal plate being determined by the following equation:

$$x=S\tau_c(1-K)$$

where, x: said prescribed length;

S: moving speed of said metal plate in said cooling apparatus;

$\tau_c$: forced cooling period of time for the portion of said metal plate other than said trailing end portion of said metal plate which remains outside of said cooling apparatus by said prescribed length and said leading end portion of said metal plate which projects outside of said cooling apparatus by said given length which equals said prescribed length; and K: constant dependent on the material and the size of said metal plate;

whereby said metal plate is cooled uniformly in the longitudinal direction thereof.

2. In a method for forcedly cooling a heated metal plate uniformly in the longitudinal direction of the metal plate, which comprises:

moving a heated metal plate horizontally in the longitudinal direction thereof at a prescribed speed through a cooling apparatus comprising a plurality of rows of nozzles arranged at prescribed intervals in the width direction of said metal plate above and below said metal plate; and, spraying a cooling liquid from said nozzles onto the upper and the lower surfaces of said metal plate during moving of said metal plate through said cooling apparatus to cool said metal plate to a prescribed temperature;

the improvement comprising:

starting said spraying of said cooling liquid from said nozzles when a prescribed length of the trailing end portion of said metal plate during moving of said metal plate still remains outside of said cooling apparatus;

discontinuing said spraying of said cooling liquid from said nozzles when a given length of the leading end portion of said metal plate during moving of said metal plate projects outside of said cooling apparatus by an amount such that said given length equals said prescribed length;

said prescribed length of the trailing end portion of said metal plate being determined by the following equation:

$$x = (L - l)\left(\frac{1 - K}{2K - 1}\right)$$

where, x: said prescribed length;

L: length of said cooling apparatus;

l: length of said metal plate; and,

K: constant dependent on the material and the size of said metal plate;

whereby said metal plate is cooled uniformly in the longitudinal direction thereof.

* * * * *